US005872340A

United States Patent [19]

Anagnos et al.

[11] Patent Number: 5,872,340

[45] Date of Patent: Feb. 16, 1999

[54] ADJUSTABLE ISOLATION MOUNTING SYSTEM FOR CENTER CHANNEL LOUDSPEAKERS

[75] Inventors: Daniel P. Anagnos, Grandview, N.Y.; Knut T. Fenner, Westfield, N.J.

[73] Assignees: Sony Corporation, Tokyo, Japan; Sony Electronics, Inc., Park Ridge, N.J.

[21] Appl. No.: 936,767

[22] Filed: Sep. 24, 1997

[51] Int. Cl.[6] ..... A47B 81/06

[52] U.S. Cl. ..... 181/199; 181/207; 248/638

[58] Field of Search ..... 181/148, 199, 181/207, 208; 248/636, 638, 649, 650, 653, 676, 677

[56] References Cited

U.S. PATENT DOCUMENTS

| | | | |
|---|---|---|---|
| 3,032,137 | 5/1962 | Rice | 181/199 |
| 5,169,104 | 12/1992 | Kwoh | 181/638 |
| 5,681,023 | 10/1997 | Sheydayi | 248/638 |

*Primary Examiner*—Khanh Dang
*Attorney, Agent, or Firm*—Ronald P. Kananen

[57] ABSTRACT

An adjustable, isolation mounting system for center channel loudspeakers has a pair of front mounting feet and a single rear mounting foot extending from a bottom surface of a loudspeaker enclosure. The rear mounting foot is adjustable in height to provide mounting flexibility and stability, and also to adjust the listening axis from the loudspeaker to the listener for optimum sound quality. The rear mounting foot also has a swivel foot member mounted on its bottom end to provide a stable support on irregular mounting surfaces. The front mounting feet are made of a vibration isolating material to isolate vibrations of the loudspeaker enclosure from the mounting surface on which the loudspeaker is supported. A vibration isolating pad is bonded to a recessed bottom surface of the swivel foot member on the rear mounting foot to further isolate vibrations of the loudspeaker enclosure from the mounting surface. The rear mounting foot is located at approximately two-thirds of the depth of the loudspeaker enclosure so that a relatively large loudspeaker can be placed on a narrow mounting surface.

20 Claims, 3 Drawing Sheets

ADJUSTABLE ISOLATION MOUNTING SYSTEM FOR CENTER CHANNEL LOUDSPEAKERS

BACKGROUND OF THE INVENTION

1. Field of the Invention

The present invention relates generally to arrangements for mounting loudspeakers and, in particular, to an adjustable, isolation mounting system for supporting a loudspeaker on an irregular surface, such as on top of a TV/monitor enclosure, and for isolating vibrations of the loudspeaker from the mounting surface.

2. Description of the Related Art

A loudspeaker operates by converting electrical energy into vibrational (sound) energy using one or more transducers. Transducers transmit vibrational energy through their frame, which is usually made of metal or plastic, into the walls of the loudspeaker cabinet. This vibrational energy propagates freely throughout the cabinet and may be introduced into the structure on which the loudspeaker cabinet is placed.

Center channel loudspeakers are typically used in home theater and audio/video systems to reproduce sound (usually dialogue) that should be centered on a TV/monitor screen. To obtain a centered sound effect, center channel loudspeakers are generally mounted on top of the TV/monitor enclosure or on a shelf centered above or below the TV/monitor. The center channel loudspeaker should be mounted as close to the center of the TV/monitor as possible to generate audio that sounds like it is coming from the center of the picture.

Center channel loudspeakers are usually small in size to make them practical to mount on a TV/monitor or bookshelf surface, and neutral in appearance so as to blend into the overall look of the TV/monitor. Center channel speakers usually have only midrange and upper frequency transducers because large bass frequencies cannot be produced without a large speaker cabinet, which is difficult to mount on top of a TV/monitor using conventional mounting arrangements.

There are several problems related to the use of center channel loudspeakers in a home theater or audio/video system. First, mounting of the loudspeaker on the top surface of a TV/monitor enclosure, which typically exhibits a very narrow flat ridge along the top front edge and an irregular, sometimes curved or sloping top surface, is often very difficult and unstable. Second, the listening axis from the speaker to the listener is usually not ideal (i.e., not 0 degrees). Third, the loudspeaker produces vibrational energy which is transmitted into the TV/monitor on which it is mounted, thereby causing noise and vibration within the TV/monitor enclosure.

Other manufacturers have dealt with these problems and issues only partially. Typically, four rubber feet are used to support center channel loudspeakers with a very shallow cabinet. Unfortunately, the use of four feet makes leveling the speaker on an irregular surface very difficult and, in some cases, impossible, especially if the rear two feet are not resting on the same flat surface as the front two feet. Usually, the rubber feet used are not truly isolating at the audio frequencies of importance, thereby yielding no significant reduction of transmitted vibrational energy. Typically, no provision has been made for altering the listening axis of the loudspeaker. Finally, the use of a shallow cabinet depth is not conducive to good sound quality due to internal cabinet reflections and standing wave phenomena. This last point is particularly important because the sound of the center channel loudspeaker must be of very high quality and tonally matched to that of the main loudspeakers.

SUMMARY OF THE INVENTION

It is an object of the present invention to provide an adjustable, isolation mounting system for loudspeakers, which solves the problems with the existing loudspeaker mounting systems described above.

It is a further object of the present invention to provide a loudspeaker mounting system that isolates a loudspeaker's vibrational energy from the structure on which it is mounted to minimize noise and vibration within the structure.

It is a further object of the present invention to provide a loudspeaker mounting system that provides a stable, balanced mounting of the loudspeaker cabinet on narrow, irregular surfaces.

It is a further object of the present invention to provide a loudspeaker mounting system that is adjustable to change the listening axis from the loudspeaker to the listener for optimum sound quality.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

The present invention provides an adjustable, isolation mounting system for center channel loudspeakers, which has a pair of front mounting feet and a single rear mounting foot extending from a bottom surface of the loudspeaker enclosure. The rear mounting foot is adjustable in height to provide mounting flexibility and stability, and also to adjust the listening axis from the loudspeaker to the listener for optimum sound quality. The rear mounting foot also has a swivel foot member mounted on its bottom end to provide a stable support on irregular mounting surfaces.

The front mounting feet are made of a vibration isolating material to isolate vibrations of the loudspeaker enclosure from the mounting surface on which the loudspeaker is supported. A vibration isolating pad is bonded to a recessed bottom surface of the swivel foot member on the rear mounting foot to further isolate vibrations of the loudspeaker enclosure from the mounting surface. The rear mounting foot is located at approximately two-thirds of the depth of the loudspeaker enclosure so that a relatively large loudspeaker can be placed on a narrow mounting surface.

In accordance with a first broad aspect of the present invention, a loudspeaker mounting system is provided comprising: a loudspeaker cabinet having a bottom surface; a pair of front feet extending downwardly from the bottom surface in front of a center of gravity of the loudspeaker cabinet; and a rear foot assembly extending downwardly from the bottom surface behind the center of gravity, the rear foot assembly having a height-adjustable, swiveling foot for engaging a mounting surface.

According to a second broad aspect of the present invention an adjustable, isolation mounting system for supporting an object is provided, comprising: a pair of front feet extending downwardly from the object in front of a center of gravity of the object, the front feet being made of a vibration isolating material; and a single, adjustable rear foot extending downwardly from the object at an approximate center of the object behind the center of gravity, the rear foot being vertically adjustable relative to the object and having a vibration isolating pad secured to a lower surface of the rear foot. The rear foot comprises a threaded stud member for providing a vertical adjustment relative to the object, and a swivel foot connected to a lower end of the threaded stud member through a ball joint, the vibration isolating pad being secured to a bottom surface of the swivel foot.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

Figure 1:
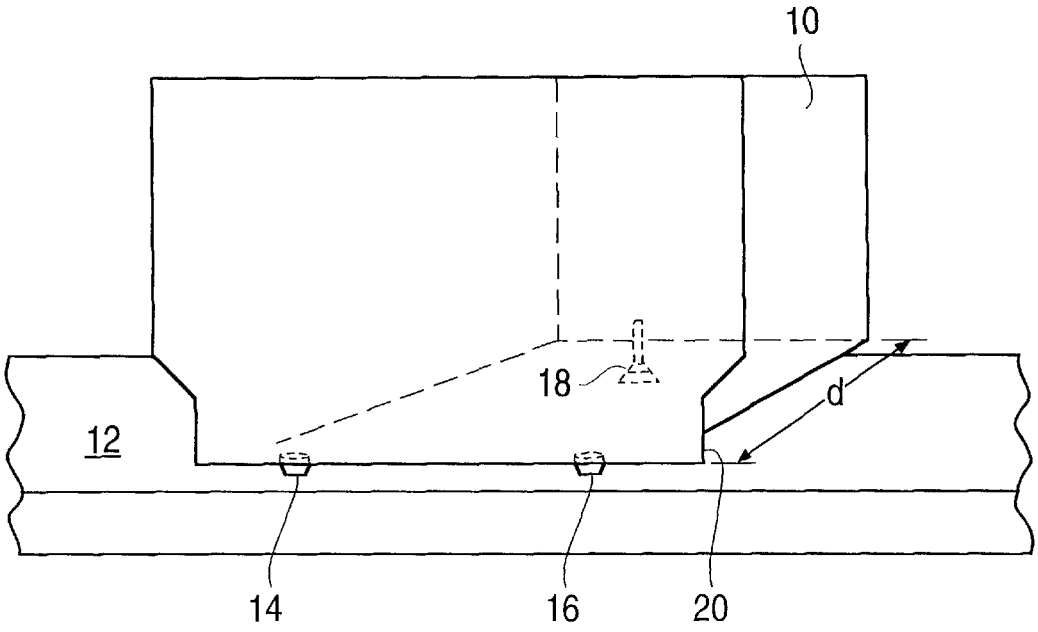
FIG. 1 is a perspective view of a center channel loudspeaker equipped with an adjustable, isolation mounting system according to the present invention and supported on top of a TV/monitor.
Figure 2A:
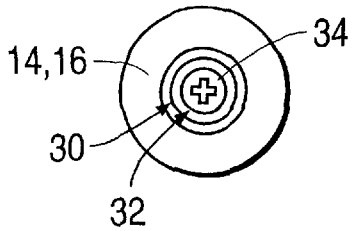
FIGS. 2(*a*) and 2(*b*) show a plan view and partial section view, respectively, of a rigidly mounted front isolation foot according to the present invention.
Figure 2B:
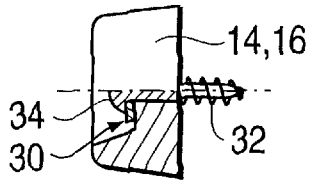

A preferred embodiment of an adjustable, isolation mounting system for mounting a center channel loudspeaker 10 on top of a TV/monitor enclosure 12 will now be described with reference to FIGS. 1 to 4 of the drawings.

The mounting system according to the present invention comprises a pair of rigidly mounted front isolation feet 14, 16 and a single, height-adjustable, swiveling, rear isolation foot 18. The two front feet 14, 16 are mounted close to the front edge 20 of the loudspeaker cabinet 10 within recessed counterbores 22, 24 of the bottom surface 26 of the cabinet 10. The rear foot 18 is mounted at the center of the cabinet 10, at about two-thirds of the overall depth d of the cabinet 10. A cantilevered overhang 28 of the cabinet 10 extends past the rear foot, to the rear of the cabinet 10. The center of gravity for the loudspeaker is between the front and rear feet 14, 16, 18 such that the three-point mounting system of the present invention provides a stable support for the speaker (i.e., the cabinet 10 does not have a tendency to lean rearward).

The front isolation mounting feet 14, 16 are formed of a highly isolating, energy absorbing thermoplastic alloy (described below), which provides effective isolation from vibration. The front mounting feet 14, 16 are each mounted to the cabinet 10 using a flat washer 30 and mounting screw 32. The flat washers 30 prevent over-compression of the front mounting feet 14, 16 by the heads 34 of the mounting screws 32 and prevent the heads from forcing themselves through the relatively compliant material of the front mounting feet 14, 16.

Figure 3A:
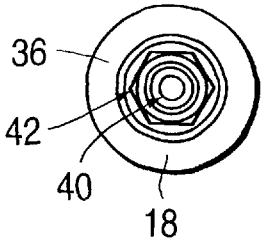
FIGS. 3(*a*) and 3(*b*) show a plan view and partial section view, respectively, of a height-adjustable, swiveling, rear isolation foot according to the present invention.
Figure 3B:
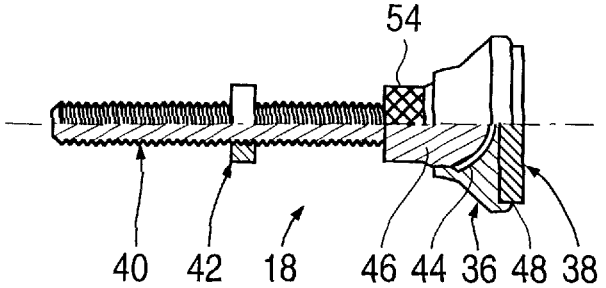

As shown in FIGS. 3(*a*) and 3(*b*), the height-adjustable, swiveling, rear isolation foot assembly 18 comprises a swivel foot 36, an isolation pad 38, a swivel stud 40, and a jam nut 42. The swivel foot 36 is machined from a fairly soft plastic (e.g., polypropylene). The swivel foot 36 has a female receptacle 44 for receiving the male end 46 of a standard ball joint. The swivel foot 36 also has a slight counterbore 48 on its bottom edge for centering the isolation pad 38.

The isolation pad 38 is die-cut from a sheet of solid, cross linked, thermoset, polyurethane elastomer (described below), which is designed to isolate vibrational energy. The isolation pad 38 has a pressure-sensitive adhesive on one surface to allow permanent attachment to the swivel foot 36.

Figure 4:
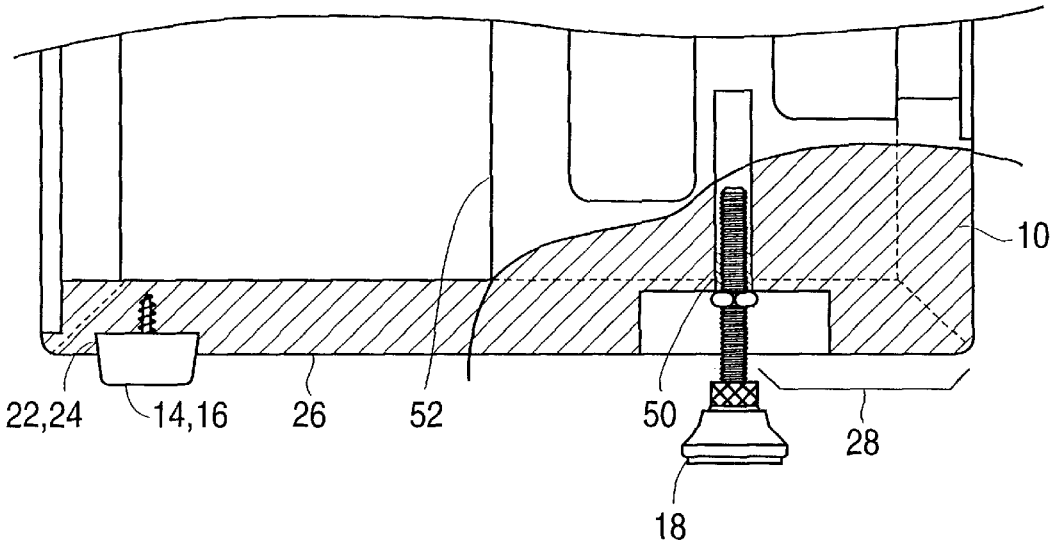
FIG. 4 is a partial section view of a bottom portion of a loudspeaker cabinet equipped with an adjustable, isolation mounting system according to the present invention.

The swivel stud 40 is a threaded steel rod with the male end 46 of the ball joint machined at one end thereof. The swivel stud 40 threads through a metal, threaded insert 50 anchored in the speaker cabinet 10. The jam nut 42 is a low profile (i.e., low thickness) nut designed to be tightened against the threaded insert 50 in the speaker cabinet 10, thereby setting the height of the rear foot 18 relative to the speaker cabinet 10. When the rear foot 18 is in its shortest (lowest) position, the swivel stud 40 is inserted up into the loudspeaker enclosure 10 and the jam nut 42 is omitted (the stud 40 is tightened directly against the threaded insert 50). There is no danger of air leakage out of the speaker cabinet 10 because the threaded insert 50 and hole which accepts the swivel stud are within a central brace 52 of the cabinet 10, as shown in FIG. 4. When the rear foot 18 is adjusted for its longest (highest) position, the swivel stud 40 is held by the threaded insert 50 outside of the speaker cabinet 10. The jam nut 42 is used to set and fix the exact height of the swivel stud 40 relative to the speaker cabinet 10.

The adjustable mounting system of the present invention operates as follows. The user places the loudspeaker on the mounting surface, for example, a top surface of a CRT-type TV/monitor 12. The two front feet 14, 16 are placed along the flat, front edge of the TV/monitor 12. The rear foot 18 is adjusted in height by first loosening the jam nut 42, then unscrewing (raising) the swivel stud 40. When the swivel foot 36 makes contact with the top surface of the TV/monitor enclosure 12, the jam nut 42 is retightened against the threaded insert 50 within the speaker enclosure 10. The swiveling feature (the ball joint) of the rear foot 18 allows even more flexibility in obtaining a solid mounting to an irregular, highly sloped or curved surface (e.g., the top surface of a TV/monitor enclosure).

If necessary, the listening axis of the loudspeaker (i.e., a line from the center of the loudspeaker to the center of the listener's head at ear level) can be adjusted upward or downward (i.e., the cabinet 10 can be tilted), depending upon the height of the loudspeaker relative to the listener's ear level. If adjustment to a maximum upward angle of the loudspeaker is desired, the jam nut 42 can be omitted as described above. A knurled area 54 on the swivel stud 40 facilitates rotation of the swivel stud 40 relative to the speaker cabinet 10, and permits tightening of the assembly when the jam nut 42 is not used.

The front and rear mounting feet 14, 16, 18 are preferably attached to the loudspeaker cabinet 10 during production of the cabinet, thereby simplifying the setup by the user. Thus, the user need only make a height adjustment of the rear mounting foot 18 to setup the loudspeaker.

The adjustable, rear foot 18 requires two subassembly operations, which can be performed before assembly to the loudspeaker cabinet 10: attachment of the swivel foot 36 to the swivel stud 3, and attachment of the isolation pad 38 to the swivel foot 36. The front two feet 14, 16 require flat washers 30 beneath the mounting screws 32 to prevent the heads of the mounting screws 32 from either over-compressing the front feet 14, 16 or forcing themselves through the screw holes.

As the height of the center channel speaker relative to the listener cannot be predetermined, the user will need to adjust the height of the rear swivel foot 18 to provide the best listening axis orientation, which should be within +/−15 degrees of parallel to the tweeter axis. This has to be done in conjunction with establishing a stable, balanced mounting of the speaker itself upon the TV/monitor or other mounting surface. Obviously, in the case of larger, rear projection-type TVs, this will be less of an issue. In the case of large, front projection-type projector TVs, floor mounting is possible if the listening axis is adjusted upward using the minimum height of the adjustable rear foot 18.

A suitable vibration isolating material for the front mounting feet 14, 16 that meets the requirements outlined above is produced by E-A-R Specialty Composites, a division of Cabot Safety Corporation, and is sold under the proprietary name ISODAMP® C-1000 SERIES ISOLATION MATERIALS (Product No. C1002). This material is composed of a highly isolating, energy absorbing thermoplastic alloy, and has been designed especially to provide isolation from vibration. The following Table 1 provides a listing of acceptable physical and strength properties for the vibration isolating material of the front feet 14, 16 according to the present invention.

TABLE 1

PROPERTIES OF FRONT FEET MATERIAL

| PROPERTY | TEST METHOD | TEST RESULT |
|---|---|---|
| Specific Gravity | ASTM D792 | 1.289 |
| Glass Transition, Tg | ASTM E756 | −20° C. |
| Hardness | ASTM D2240 Shore A durometer 15 sec. post impact @ 23° C. | 56 |
| Rebound | ASTM D2632 (Modified) Bashore Resilience | |
| | % Rebound (first) | 4.8% |
| | Min. Rebound Temp. | 21° C. |
| Outgassing | ASTM E595 (Modified) 24 hr. at 10–6 Torr | |
| | Total Mass Loss Water | 0.067% |
| | Reabsorbed | @40° C. 0.043% |
| Dielectric Strength | ASTM D149 Breakdown Voltage | 166 volts/mil |
| Thermal Conductivity | ASTM C177 BTU in./hr. sq. ft. °F. | 1.00 |
| Coefficient of Friction | ASTM D3389 on Etched Aluminum | |
| | Static | 0.92 |
| | Kinetic | 0.75 |
| Compressive Deformation | ASTM D621 Method B 24° C. | |
| | % Deformation (3 hr.) | 10.4% |
| | % Deformation (1.5 hr.) | 90.4% |
| Compression Set | ASTM D395 Method B | |
| | 22 hr. at 22° C. (72° F.) | 14% |
| | 22 hr. at 80° C. (176° F.) | 62% |
| Tensile Strength | ASTM D903 | 1574 psi |
| Elongation | ASTM D903 | 459% |
| Tensile Modulus | ASTM D903 | 450 psi |
| Tear Strength | ASTM D1004 0.125" Samples | 25.2 lb. |
| Abrasion Resistance | ASTM D3389 H22 stone, 1000 g load Wear Factor | 242 |

The vibration isolating material also has excellent resistance to adverse environmental conditions, such as ozone, ultraviolet radiation, and chemicals.

A suitable vibration isolating material for the pad 38 mounted to the rear foot 18 that meets the requirements outlined above is also produced by E-A-R Specialty Composites, and is sold under the proprietary name ISO-LOSS® HD MOLDED DAMPED-ISOLATION PRODUCTS (Product No. HD-12). This material is composed of a solid, cross linked, thermoset, polyurethane elastomer designed specifically to isolate vibrational energy. The following Table 2 provides a listing of acceptable physical and strength properties for the material of the rear foot pad 38 according to the present invention.

TABLE 2

PROPERTIES OF REAR FOOT ISOLATING PAD MATERIAL

| PROPERTY | TEST METHOD | TEST RESULT |
|---|---|---|
| Specific Gravity | ASTM D792 | 1.246 |
| Glass Transition, Tg | ASTM E756 | −10° C. |
| Hardness | ASTM D2240 Shore A durometer 15 sec. post impact @ 23° C. | 56 |
| Rebound | ASTM D2632 Bashore Resilience | |
| | % Rebound (first impact) | 4.5% |
| | % Rebound (second impact) | 0 |
| Outgassing | ASTM E595 (Modified) 24 hr. at 10–6 Torr | |
| | Total Mass Loss Water | 0.46% |
| | Reabsorbed | 0.28% |
| Compressive Load Deflection | ASTM D575 (.2 in/min), psi 10% deflection | 94 |
| | 20% deflection | 191 |
| | 30% deflection | 317 |
| Compressive Modulus | ASTM D575 .2 in/min (psi) | 879 |
| Elongation | ASTM D638, % | 424% |
| Tensile Modulus | ASTM D638, psi | 675 psi |
| Tear Strength | ASTM D1004 0.125" Samples | 27.3 lb. |
| Abrasion Resistance | ASTM D3389 H22 stone, 1000 g load Wear Factor, mg | 61 |

To summarize, the adjustable, isolation mounting system according to the present invention provides the following advantages and features:

(1) A stable, balanced mounting of the loudspeaker cabinet on most TV/monitors is provided, even those exhibiting very narrow front, top edges and irregular, sloped or curved top surfaces. The rear foot's adjustable height and ball joint swivel, as well as the high level of grip on all three feet combine to offer a maximum combination of mounting flexibility and stability.

(2) The listening axis from the loudspeaker to the listener can be adjusted for optimum sound quality (i.e., within +/−15 degrees from the tweeter axis to a listeners' ear level). This is particularly important in two cases: for large, rear projection-type TVs where the loudspeaker height is considerably higher than the listeners' ear level, and for large, front projection-type TVs where the loudspeaker must be mounted at floor level, considerably below the listeners' ear level.

(3) An ideal isolation of the vibrational energy produced by the loudspeaker from the sometimes thin, flexible, resonant-prone TV enclosure panels is provided, whereby buzzes and noises from the TV enclosure panels will be greatly reduced.

(4) A loudspeaker cabinet deeper than usually allowable in such circumstances can be utilized, thereby providing a higher quality sound.

The mounting system according to the present invention is not limited to use with a center channel loudspeaker. The mounting system can be utilized, for example, in any situation where irregular mounting surfaces are encountered and where isolation from vibration is a requirement.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims.

What is claimed is:

1. A loudspeaker mounting system, comprising:

a loudspeaker cabinet having a bottom surface;

a pair of front feet extending downwardly from the bottom surface in front of a center of gravity of the loudspeaker cabinet; and a rear foot assembly extending downwardly from the bottom surface behind said center of gravity, said rear foot assembly having a height-adjustable, swiveling foot for engaging a mounting surface.

2. The loudspeaker mounting system according to claim 1, wherein the front feet are mounted to the loudspeaker cabinet adjacent a front edge of the cabinet, and the rear foot is mounted at an approximate lateral center of the loudspeaker cabinet behind the center of gravity of the loudspeaker cabinet.

3. The loudspeaker mounting system according to claim 2, wherein the rear foot is mounted to the speaker cabinet at approximately two-thirds of the depth dimension of the speaker cabinet, whereby a cantilevered overhang of the speaker cabinet extends past the rear foot to a rear side of the speaker cabinet.

4. The loudspeaker mounting system according to claim 1, wherein said rear foot assembly consists of a single height-adjustable, swiveling foot located at an approximate center of the speaker cabinet behind the center of gravity of the speaker cabinet.

5. The loudspeaker mounting system according to claim 1, wherein said rear foot assembly comprises a swivel stud member threaded into said loudspeaker cabinet and a swivel foot connected to said swivel stud member through a ball joint.

6. The loudspeaker mounting system according to claim 5, wherein said swivel foot comprises a female receptacle for receiving a male end of the swivel stud member.

7. The loudspeaker mounting system according to claim 5, further comprising a jam nut threaded on said swivel stud member for setting the height of the rear foot assembly.

8. The loudspeaker mounting system according to claim 5, wherein said swivel stud member comprises a knurled portion to facilitate threading the swivel stud member into and out of the loudspeaker cabinet.

9. The loudspeaker mounting system according to claim 1, wherein said front feet are made of a vibration isolating, energy absorbing thermoplastic alloy.

10. The loudspeaker mounting system according to claim 1, wherein said front feet are made of a compliant isolating material and are each secured to the loudspeaker cabinet using a flat washer and mounting screw, whereby the flat washers prevent over-compression of the front feet by the mounting screws and prevent heads of the mounting screws from forcing themselves through the compliant material.

11. The loudspeaker mounting system according to claim 1, wherein said rear foot assembly further comprises a vibration isolating pad secured to a lower end of said swiveling foot.

12. The loudspeaker mounting system according to claim 11, wherein said swiveling foot has a counterbore recess on a bottom edge for receiving said vibration isolating pad.

13. The loudspeaker mounting system according to claim 11, wherein said vibration isolating pad is made from a solid, cross linked, thermoset, polyurethane elastomer material designed to isolate vibrational energy.

14. A loudspeaker assembly, comprising:

a loudspeaker enclosure having a bottom surface; and a mounting system for mounting the loudspeaker enclosure on a mounting surface, said mounting system comprising a pair of front feet extending downwardly from said bottom surface in front of a center of gravity of said loudspeaker enclosure, and a rear foot extending downwardly from said bottom surface at an approximate center of the loudspeaker enclosure behind said center of gravity, said rear foot being vertically adjustable relative to said loudspeaker enclosure.

15. The loudspeaker assembly according to claim 14, wherein said rear foot has a swivel foot member connected to a swivel stud through a ball joint for ensuring a stable support of the rear foot on an irregular mounting surface.

16. The loudspeaker according to claim 15, wherein said rear foot has a vibration isolating pad secured to a lower end of said swivel foot member.

17. The loudspeaker according to claim 14, wherein said rear foot extends from the bottom surface of the loudspeaker enclosure at a location about two-thirds of the overall depth of the enclosure, whereby a cantilevered overhang of the loudspeaker enclosure extends past the rear foot to a rear side of the loudspeaker enclosure.

18. The loudspeaker according to claim 14, wherein said front feet are made of a vibration isolating, energy absorbing thermoplastic alloy.

19. An adjustable, isolation mounting system for supporting an object, comprising:

a pair of front feet extending downwardly from said object in front of a center of gravity of said object, said front feet being made of a vibration isolating material; and a single, adjustable rear foot extending downwardly from said object at an approximate center of the object behind said center of gravity, said rear foot being vertically adjustable relative to said object and having a vibration isolating pad secured to a lower surface of the rear foot.

20. The adjustable, isolation mounting system according to claim 19, wherein said rear foot comprises a threaded stud member for threaded adjustment relative to said object, and a swivel foot connected to a lower end of said threaded stud member through a ball joint, said vibration isolating pad being secured to a bottom surface of said swivel foot.

* * * * *